US005673862A

United States Patent [19]

Wingler

[11] Patent Number: 5,673,862

[45] Date of Patent: Oct. 7, 1997

[54] GRAIN MILL

[75] Inventor: Edward C. Wingler, Scottsville, N.C.

[73] Assignee: New River Mills, L.L.C., Columbia, S.C.

[21] Appl. No.: 629,981

[22] Filed: Apr. 9, 1996

[51] Int. Cl.[6] ..... B02C 7/14

[52] U.S. Cl. ..... 241/81; 241/259.1

[58] Field of Search ..... 241/259.1, 261.2, 241/261.3, 35, 37, 81, 55, 34, 117, DIG. 38

[56] References Cited

U.S. PATENT DOCUMENTS

| | | | |
|---|---|---|---|
| 1,847,967 | 3/1932 | Keefer . | |
| 1,864,595 | 6/1932 | Howson . | |
| 2,249,648 | 7/1941 | Fehr . | |
| 2,273,868 | 2/1942 | Johnston . | |
| 2,330,969 | 10/1943 | Harries . | |
| 2,467,691 | 4/1949 | Pendergast . | |
| 2,494,705 | 1/1950 | Hamilton . | |
| 3,040,996 | 6/1962 | Ginaven . | |
| 3,556,421 | 1/1971 | Galanty . | |
| 3,617,006 | 11/1971 | Jones | 241/34 X |
| 3,638,871 | 2/1972 | Barger . | |
| 3,688,996 | 9/1972 | Kuest . | |
| 3,761,027 | 9/1973 | Mendoza . | |
| 3,880,367 | 4/1975 | Grover . | |
| 3,930,878 | 1/1976 | Mendoza . | |
| 3,942,730 | 3/1976 | Coucher . | |
| 4,022,388 | 5/1977 | Schnitzer . | |
| 4,037,801 | 7/1977 | Jimenez . | |
| 4,039,152 | 8/1977 | Peterson . | |
| 4,039,153 | 8/1977 | Hoffman | 241/261.2 X |
| 4,057,194 | 11/1977 | Orton . | |
| 4,074,869 | 2/1978 | Johnson | 241/55 |
| 4,076,177 | 2/1978 | Hirayama et al. | 241/DIG. 38 X |
| 4,082,234 | 4/1978 | Hoffman . | |
| 4,201,349 | 5/1980 | Walsh . | |
| 4,235,385 | 11/1980 | Brundiek | 241/117 X |
| 4,237,589 | 12/1980 | Boothe . | |
| 4,339,083 | 7/1982 | Linzberger et al. | 241/37 |
| 4,422,578 | 12/1983 | Scott . | |
| 4,449,670 | 5/1984 | Tloczynski et al. | 241/35 |
| 4,502,643 | 3/1985 | Burggrabe . | |
| 4,667,888 | 5/1987 | Andersen . | |
| 4,896,836 | 1/1990 | Mitchell | 241/81 |
| 5,297,744 | 3/1994 | Clinton | 241/81 |

*Primary Examiner*—Mark Rosenbaum
*Attorney, Agent, or Firm*—Michael A. Mann, P.A.

[57] ABSTRACT

A grain mill is disclosed comprising a heat-dissipating, stainless steel housing that holds a pair of grinding stones, one of which rotates with a shaft turned by an electric motor. The shaft is journaled on self-aligning bearings. The bearings and the housing cooperate to keep heat buildup from the grinding operation low so as not to damage the grain, even at higher grinding speed. As an additional check on mill temperature, a thermometer is included to provide temperature information, and an ammeter is connected to the electrical motor to provide information about the electrical current being drawn when the motor rotates the shaft as an indication of the stress on the shaft. A small door near the exit spout permits a check of the uniformity and size of the ground product. Finally, magnets on the hopper attract metal particles and hold them so that they do not enter the space between the grind stones, where they could damage the stones and become part of the product. Accordingly, the present mill is capable of higher productivity and a higher quality product. Numerous other improvements in the present mill make it easier to operate and more durable.

16 Claims, 4 Drawing Sheets

71
74
86
82
96
84
90
70
73

78
77
73
73
76
70
82
86
96
84
76
71
90
71
88
80
77
78
84
86
76
72
77
71
78

130
132
138
140
142
144
134
133
150
94
90
136
135
144
146
154
152

GRAIN MILL

BACKGROUND OF THE INVENTION

1. Field of the Invention

The present invention relates to mills for grinding or milling grains such as wheat, rice, corn, oats, rye, barley, and coffee. More particularly, the present invention is a portable flour mill for use by a small bakery.

2. Discussion of Background

There exists in the art a variety of different rotary grinding mills for grinding wheat, corn, rye, oats, barley, rice, coffee, and other grains. Mills have been known for centuries. Currently, small portable mills are used by smaller bakeries to mill grains for specialty breads. Mill technology is very traditional. Typically, such machines comprise a cast iron housing with a pair of circular, pink granite grinding stones, spaced a preselected, small distance apart. One of the stones, commonly referred to as the "running stone," is turned by a shaft, while the other stone, the "bed" stone, remains stationary. Grain is fed into the mill from a hopper to a rotating auger, and then into the space defined by the separation between the opposing faces of the stones. After the grain is milled to flour, the flour is removed from the interior of the mill for collection and further processing.

One problem repeatedly encountered in the art is the durability of the moving components of the mill. In particular, the shaft can be seized by the cast iron ball beating assemblies through which the shaft is journaled when frictional heat welds the bearings to the shaft. Also, vibration from the motor that turns the shaft along with misalignment of the running stone causes the mining shaft to deviate from its normal, horizontal position, resulting in interference, frictional heat buildup, and excessive wear. In addition, heat from friction can damage the grain, as will be explained below.

If the machine is run continuously, heat builds in the housing and heats the grain. When the grain becomes overheated, it begins to break down chemically. For example, when wheat embryo, or the wheat kernel, experiences a temperature of approximately 130° F. or greater, it loses its protein content. Furthermore, products made from overheated wheat flour are less flavorful. To limit heat buildup as well as prevent damage to moving parts, the running stone is rotated at a slower speed and for shorter periods of time to allow dissipation of the heat. However, neither of these solutions is acceptable, since both adversely affect the productivity of the grinding operation.

Another problem is the existence of metal particles that chip off of the hopper and fall into the wheat. Most mills sift the wheat, as has been done for decades, to remove stones and other foreign particles. However, metal particles are not removed. These contact the stone faces and produce surface irregularities that affect the surface of the grinding stones and require them to be smoothed and flattened, or "dressed," more frequently. In addition, failure to remove these metal particles prior to milling affects flour quality.

Size inconsistencies in the milled product are yet another problem faced by the industry. Normally, the distance between the grinding stones, and hence the resulting fineness of the milled product, is adjusted by using a threaded screw, usually having eight threads per inch, which is positioned to abut the end of the turning shaft. Turning the screw moves the shaft, and thus the relative positions of the running and bed stones. Rotation of the shaft exerts a force in the direction of the screw that, over time, wears on the screw's threads. Eventually, the adjustment screw cannot be relied on to accurately maintain the correct separation of the stones, and as a result, the output from the mill contains particles of non-uniform size.

Because of the traditional approach to mill manufacture, the problems of heat buildup, frequent breakdowns, low output, and uneven quality of the output have not been addressed. There exists a need for a durable mill that produces a high quality product with high productivity.

SUMMARY OF THE INVENTION

According to its major aspects and briefly stated, the present invention is a rotary grinding mill. The mill comprises a stainless steel housing in which is mounted two grinding stones placed in spaced, opposing axial alignment. One stone, the "bed stone," is immobile or stationary, while the other, the "running stone," rotates about its axis. A shaft that is turned by a motor rotates the running stone. The shaft is journaled in self-aligning bearings that allow the shaft to deviate as much as ±30°. A screw, with preferably 24 threads per inch rather than the conventional eight threads per inch, engages one end of the shaft, and permits fine, stable adjustment of the distance between the grinding stones and the fixation of that distance.

Grain is introduced into the interior of the mill via a hopper positioned above the grinding stones and mounted to the exterior of the housing. Upon entering the hopper, the grain falls into an angled pan carrying several magnets to catch and hold metal particles in the grain. The sifter present in traditional mills has been eliminated in the present design as unnecessary, thus eliminating a source of noise and frequent mechanical problems. The grain then falls down a channel within the interior of the housing to a feed screw carried by the shaft. The feed screw forwards the grain through a cavity centrally formed in the bed stone to the space between the stones, to the area where it is subsequently milled. After being milled by the stones, the flour is swept from the interior of the housing by sweepers carried on the exterior of the running stone and is collected in a receptacle. The mill is mounted on a steel tubing frame riding on casters to facilitate movement.

A number of features of the present invention cooperate together to produce a higher-quality product. To increase production, the shaft is turned faster. However, in order to avoid the heat buildup associated with faster grinding, which would damage the grain, the housing is made of heat dissipating stainless steel, and the bearings are self-aligning so that friction is reduced from conventional cast iron housings and bearings. To give the user information related to the quality of the product, a thermometer carried by the exit spout enables a quick check on temperature. An ammeter connected to the motor that turns the shaft enables a check on the electrical current drawn by the motor as an indirect measurement of stress on the shaft from, say, overfeeding. Finally, a small door allows the user to feel the ground product for size and uniformity.

A number of features combine to make the present mill relatively trouble-free and easier to use. For example, the shaft adjustment assembly uses a fine threaded screw in a brass housing to enable the position of the shaft, and thus the running stone, to be set where the user wants it and fixes it in place so that it does not easily move from the desired location. The use of stainless steel for the housing makes it easier to clean. The removal of the traditional mechanical sifter makes the unit quieter and eliminates a source of mechanical breakdown. The use of magnets on the hopper to pick up metallic particles that would otherwise damage the stones is important because it reduces the number of times the stones need to be dressed, i.e., cleaned, smoothed, and flattened. Furthermore, when the stones need to be dressed, the longer frame of the present invention, with a polyethylene or tetrafluorohydrocarbon-coated surface, enables the stones to be slid apart easily, but left on the frame during dressing. Thus, the heavy stones do not need to be repeatedly lifted off the frame while being dressed. As a result, the otherwise unproductive time spent dressing the stones is reduced and made easier.

The use of modern self-aligning bearings which enable the running stone to rotate at a higher speed (measured in revolutions per minute or RPM) and a faster rate of rotation of the shaft improve productivity of the present mill over previous mills. The self-aligning bearings permit the shaft to deviate from its normal horizontal position to accommodate the vibration imparted by the motor and misalignment of the running stone. Consequently, the shaft is capable of rotating at a higher RPM. As a result, the mill is capable of higher output, approximately 20% higher. Specifically, a mill according to the present invention equipped with 16 inch stones is capable of grinding approximately 350–400 pounds of flour per hour. With 30 inch stones, the mill yields approximately 1000–1200 pounds per hour.

Other features and their advantages will be apparent to those skilled in the art from a careful reading of the Detailed Description of Preferred Embodiments accompanied by the following drawings.

DETAILED DESCRIPTION OF PREFERRED EMBODIMENT

The present invention is a mill for milling wheat, corn, rice, barley, rye, oats, coffee, or other grains. Ideally, the present mill is sized to mill flour for a small bakery. The mill according to the present invention will operate at a temperature not exceeding approximately 100° F. and therefore prevents thermal damage to the grains. Additionally, the mill operates at higher RPM, approximately 20% greater than existing mills, and therefore has greater productivity. It has a number of features that make it less prone to breakdown and damage and that make it easier to use.

Figure 1:
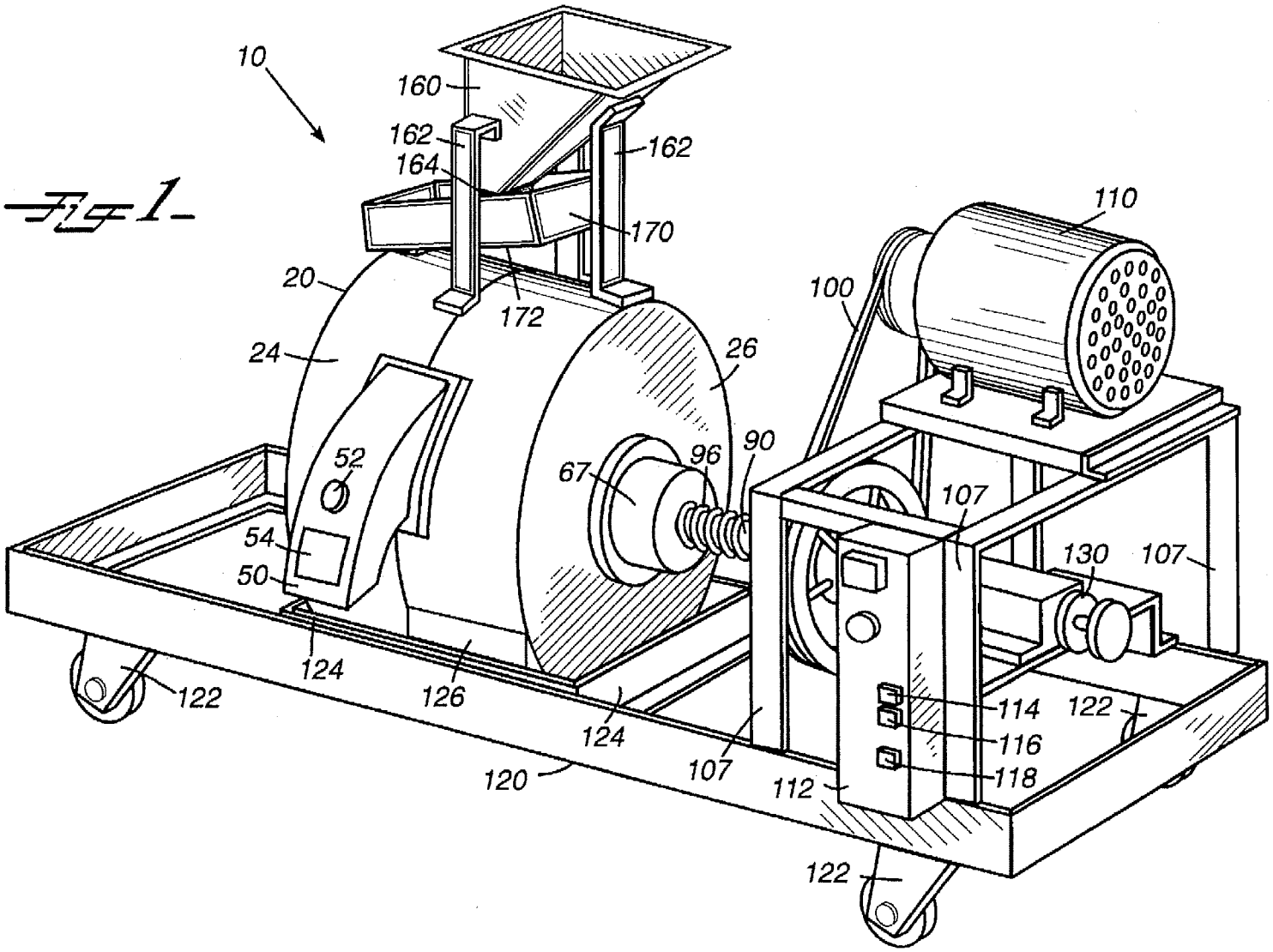
FIG. 1 is a perspective view of a grain mill according to a preferred embodiment of the present invention.
Figure 2:
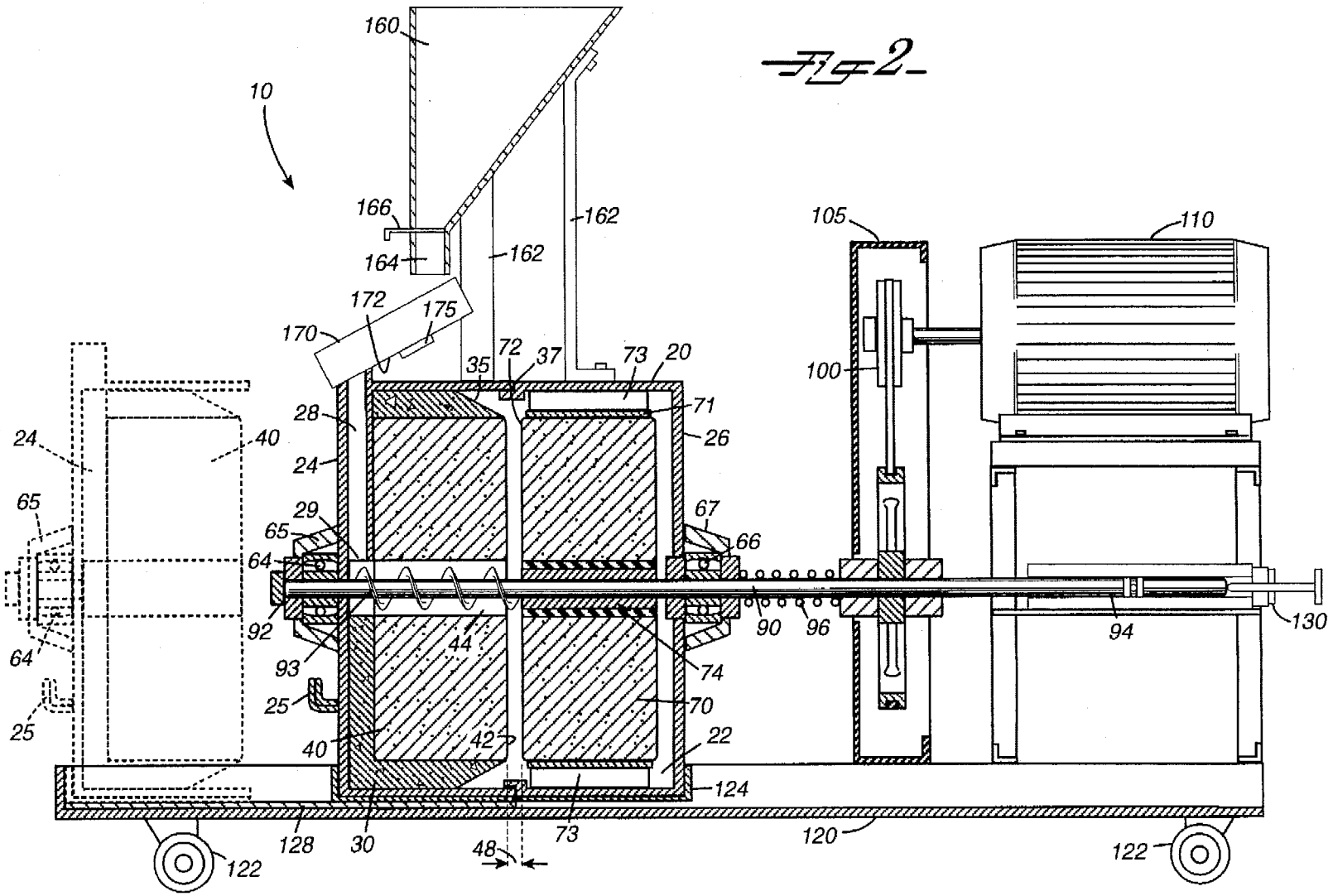
FIG. 2 is a side view of a grain mill, with a portion of the housing shown in phantom lines, according to a preferred embodiment of the present invention.

Turning now to FIGS. 1 and 2, there is shown in perspective and side cross sectional, respectively, a mill according a preferred embodiment of the present invention and indicated generally by reference numeral 10. Mill 10 comprises a stainless steel housing 20 having an interior 22, first side 24 and a second side 26, a first stone 40, and a second stone 70 located in interior 22 of housing 20, a turning shaft 90, a motor 110 for rotatably driving turning shaft 90 via drive pulley system 100, a frame 120, an adjustment assembly 130, and a hopper 160. Motor 110 is supported a distance above turning shaft 90 by a series of members 107 extending from frame 120.

Housing 20 is made to be heat dissipating, preferably by making it of a material with a high thermal conductivity (and strength) such as stainless steel. Alternatively, heat dissipating features, such as fins, can be incorporated if necessary to speed heat dissipation. However, stainless steel having a nominal thickness of ¼ inch provides a good combination of strength and high thermal conductivity needed for present purposes and is not as brittle as cast iron.

First stone 40, commonly referred to as the stationary stone, and second stone 70, the running stone, are separated by a distance 48, and each have a grinding face 42 and 72 and a cut out portion 44 and 74, respectively. Normally, stones 40 and 70 are made of pink granite which includes a small amount of marble. However, it is recognized that stones 40 and 70 can be made of any synthetic or natural material that is commonly employed in the art of milling grain. First stone 40 is rigidly affixed to interior 22 of housing 20 by cement 30. When cement 30 is laid around the perimeter of first stone 40, it is formed to have an angled surface 35. Angled surface 35 enables an annular flange 37 formed in second side 26 of housing 20 to slidingly engage first side 24. Second stone 70 has about its perimeter a metal band 71. The purpose of band 71 is to prevent dislodgment of pieces of stone 70 while the stone is rotating. Extending from band 71 are a series of blades 73. When second stone 70 rotates, blades 73 sweep grain from interior 22 of housing 20 by pushing it through an exit spout 50.

First end 92 of shaft 90 is journaled within a first set of self-aligning bearings 64 supported by first side 24 of housing 20 in a casing 65. Shaft 90 runs through cut out portion 44 of first stone 40 and is journaled to second stone 70 in a manner which will be discussed below. Upon exiting interior 22 of housing 20, shaft 90 is journaled through a second set of self-aligning bearings 66, supported by second side 26 of housing 20 in a casing 67. Shaft 90 is further connected to pulley system 100 and is maintained at a fixed distance therefrom by spring 96. Second end 94 of shaft 90 terminates within adjustment assembly 130. Positioned about pulley system 100 is a guard 105 that helps to avoid injury during the operation of mill 10.

The self-aligning bearings 64, 66 can be any type of self-aligning beating sized for the shaft. Preferably, bearings 64, 66 accommodate deviations of shaft 90 of up to 30°, but at least a few degrees in view of the weight of second stone 70, which is typically several hundred pounds.

Hopper 160 is positioned above housing 20 and is supported thereby by a plurality of members 162. About mouth 164 of hopper 160 is an adjustable gate 166. Gate 166 enables the amount of grain exiting hopper 160 to be regulated. Positioned below mouth 164 of hopper 160 is an angled pan 170 having a plurality of magnets 175 positioned in bottom 172. Magnets 175 remove metal particles from the grain as it falls from hopper 160. Removing these metal particles before they enter the mill protects the surfaces of grinding stones 40 and 70 and prevents impurities in the milled product. In prior art mills, a sifter sifted the grain for small stones and other foreign matter. The sifter was shaken by cam action of shaft 90. However, wheat, for example, is triply washed before being placed into the hopper so sifting for foreign matter is unnecessary, and thus, the sifter has been removed. Along with its removal are the associated mechanical problems and breakdowns and the noise of the sifter as it operates.

Grain runs down pan 170 and enters interior 22 of housing 20 via stainless steel channel 28. Located at the bottom 29 of channel 28 is a screw coil 93 which is arranged about shaft 90. Screw coil 93 transports grain through cut out portion 44 of first stone 40 and into the space between first stone 40 and second stone 70.

Figure 3:
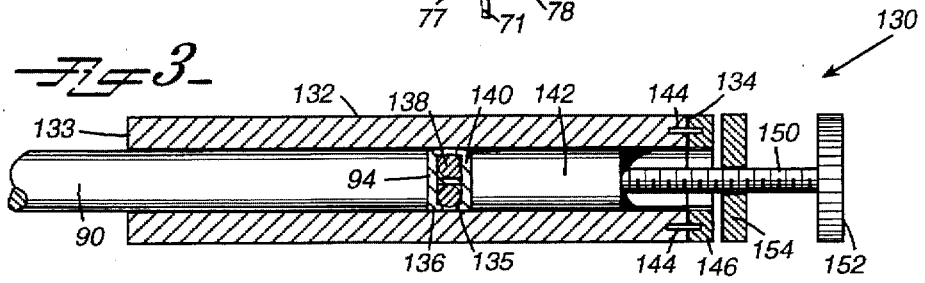
FIG. 3 is a detailed, cross sectional side view of an adjustment assembly of a grain mill according to a preferred embodiment of the present invention.

Turning now to FIG. 3, there is shown a detailed cross sectional side view of adjustment means 130. Adjustment means 130 permits distance 48 between stones 40 and 70 to be adjusted, thereby enabling the fineness of the milled grain to be controlled. Adjustment assembly 130 contains a collar 132 having a first end 133 and a second end 134. Second end 94 of shaft 90 is positioned within collar 132 and extends beyond first end 133. A thrust beating assembly 135, preferably made of brass and having a first race 136, a series of beatings 138 and a second race 140, is positioned within collar 132 and between end 94 of shaft 90 and a follow block 142. Attached to second end 134 by set screws 144 is a seal 146. An adjustment screw 150 having an adjustment nut 152 and a locking nut 154 is threaded through seal 146 and embedded in follow block 142. Preferably, adjustment screw 150 is at least 24 threads per inch so that distance 48 can be accurately adjusted, and, once adjusted, will remain fixed until the user wants to make a different adjustment. This is an important improvement. The adjustment assembly 130 sets the separation distance between the stones, which is a small distance, typically less than the thickness of a sheet of paper. This distance determines the fineness of the grind. If the distance tends to increase by the backing of shaft 90, the grind will gradually become coarser. If the distance tends to vary, the stones may interfere, thus causing premature wear, overheating, variation in grind fineness, and equipment breakdown.

Adjustment of distance 48 by adjustment assembly 130 is accomplished as follows: locking nut 154 is first rotated away from seal 146. Thereafter, adjustment nut 152 is rotated, causing follow block 142 to move linearly and thereby move shaft 90 in the same direction. When proper adjustment is achieved, locking nut 154 is rotated towards seal 146. When shaft 90 is rotating, it will transfer rotational energy into first race 136 and subsequently into beatings 138, where the energy will be absorbed. By absorbing this energy in bearings 138, damage and the eventual destruction of adjustment screw 150 is eliminated. Moreover, the correct distance 48 between stones 40 and 70 is maintained, despite continuous use.

Figure 4:
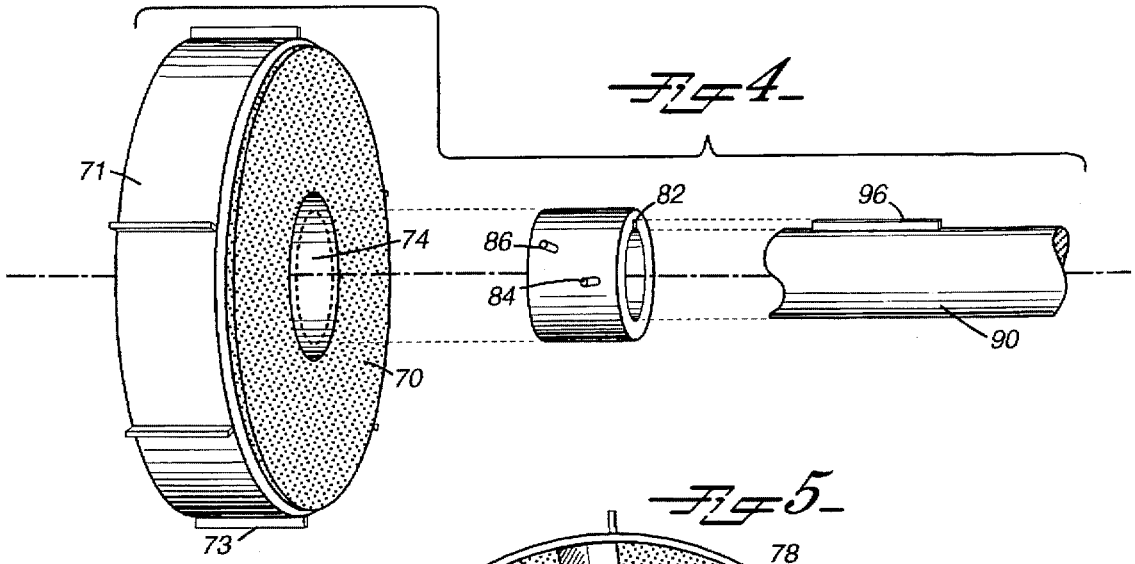
FIG. 4 is a perspective, exploded view of the running stone and shaft assembly of a grain mill according to a preferred embodiment of the present invention.
Figure 5:
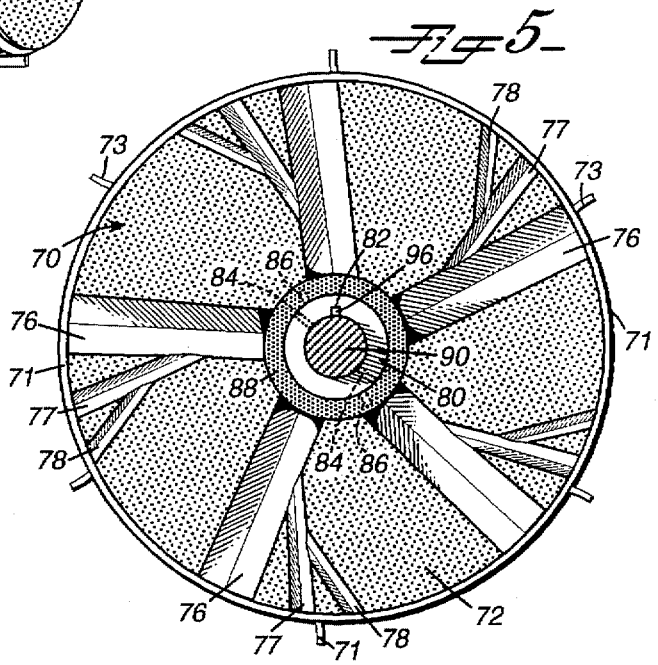
FIG. 5 is a partial cross sectional front view of the running stone and shaft assembly of a grain mill according to a preferred embodiment of the present invention.

Turning now to FIGS. 4 and FIG. 5, there is shown an exploded perspective view and front view, respectively, depicting the attachment of shaft 90 to second stone 70. Shaft 90 is fitted with a key 96 which is inserted into a slot 82 formed in an annular hub 80. Positioned about the exterior of hub 80 are a pair of set screws 84 and a pair of bolts 86. Set screws 84 are tightened onto shaft 90. Thereafter, hub 80 and shaft 90 are inserted into cut out portion 74 a distance, so that bolts 86 are within cut out portion 74 while set screws 84 are exterior to cut out portion 74. Cut out portion 74 is then filled with babbit 88 to secure hub 80 and shaft 90 to second stone 70. Any form of babbit commonly used in the art that is capable of securing shaft 90 and hub 80 to second stone 70 can be used.

There is a control panel 112 mounted to frame 120. Control panel 112 contains an "on" button 114 which activates motor 110, an "off" button 116 which deactivates motor 110, and a reset button 118. Control panel 112 also contains an ammeter 122 which monitors the current drawn by motor 110 and indirectly measures stress on the shaft being rotated by the motor. If ammeter 122 displays a current above a preselected level, it is an indication that either distance 48 between stones 40 and 70 is too small or interior 22 of mill 10 is receiving too much grain, i.e., it is being overfed. The exact amperage value which indicates the occurrence of the above described conditions will vary depending upon the size of motor 110, the desired revolutions per minute and the desired fineness of the grain, and therefore will require a modest amount of experimentation by one with ordinary skill in the art.

Positioned on exit spout 50 is a temperature gauge 52 which reads the temperature within interior 22 of housing 20. It is important that the temperature within interior 22 be below a certain value to avoid overheating the grain. The exact temperature at which overheating occurs varies depending on the type of grain being milled; however, in no instance should the temperature within interior 22 exceed 130° F. Preferably, the temperature of interior 22 is below 120° F., and most preferably below 110° F. Also positioned in exit spout 50 is an access door 54. Door 54 permits an operator to reach into and remove the milled grain flowing through exit spout 50 and to examine the grain for the required fineness and consistency.

The ammeter 122, door 54 and temperature gauge 52, missing from traditional mills, are an important source of information to the user. Without that information, the quality of the product and the condition of the mill are unknown until it may be too late to prevent the production of a grind of poor quality or damage to the mill.

Frame 120 has depending therefrom a plurality of castors 122 which aid in the movement and transportation of mill 10. There exists support members 124 positioned about the perimeter of the exterior of housing 20. In addition, about side 26 of housing 20 there are angled supports 126. Support members 124 provide additional support for housing 20, while angled supports 126 maintain side 26 of housing 20 in alignment during the rotation of grinding stone 70.

In operation, the distance 48 between stones 40 and 70 is adjusted using adjustment assembly 130, as described above. The operator then activates mill 10 by depressing "on" button 114. At this point, motor 110 rotates shaft 90 and grinding stone 70 via pulley system 100. Thereafter, a charge of grain is placed within hopper 160. The grain will travel through hopper 160, over magnets 175 positioned within pan 170, and into channel 28 within interior 22. The grain will then be forwarded to the space between grinding stones 40 and 70.

Grain received in the space between stones 40 and 70 is caused by the rotation of stone 70 to enter main furrows 76 formed in face 72 of stone 70, as illustrated in FIG. 5. Furrows 76 are V-shaped and have a depth of approximately ½ inch and a width of approximately 1 and ½ inches. Furrows 76 are connected to secondary furrows 77 and 78. Secondary furrows 77 and 78 are also V-shaped and are of lesser depth and width than main furrows 76. The centrifugal force exerted on the grain will cause it to migrate from the center of face 72 to its perimeter through furrows 76, 77 and 78. As the grain moves outward, centrifugal force will also force grain from furrows 76, 77 and 78. Such grain will contact faces 42 and 72 of stones 40 and 70 and will be milled to the desired fineness.

Grain that has been ground to the required fineness will be thrust from between faces 42 and 72 and will be swept by blades 73 from interior 22 through exit spout 50. Upon exiting spout 50, the grain may be received by the proper receptacle or container (not shown). Optionally, exit spout 50 may be attached to a T-connector and its dedicated motor and pump system. A T-connector (not shown) is a device well known to artisans with ordinary skill in the art of milling, that further separates grain based upon particle size or type of grain by forcing air through the milled grain.

During operation of mill 10, first and second sets of self aligning beatings 64, 66 will automatically compensate for the deviation of shaft 90 from its horizontal axis due to the vibration of motor 110 and the misalignment of second stone 70. Consequently, shaft 90 will not experience excessive friction with self aligning bearings 64 and 66. Moreover, the issue of shaft seizure is greatly reduced. As a result, shaft 90 is capable of operating at higher rotational speeds, approximately 20% greater than existing mills, with correspondingly greater output. For example, with 16" stones, mill 10 yields an output between approximately 350 and 400 pounds per hour. A mill 10 having 30" stones will yield approximately between 1000 and 1100 pounds per hour.

The heat generated within interior 22 is effectively dissipated to the exterior by stainless steel housing 20. This heat dissipation which is characteristic of housing 20 is responsible for maintaining an average operating temperature of between approximately 85° F. and 100° F. Therefore, thermal damage to grain as a result of heat is eliminated.

When it is required to dress stones 40 and 70 or interior 22 of mill 10, an operator first removes hopper 160 from housing 20. Dressing the stones is a process of cleaning, smoothing and flattening the stones. Thereafter, using handles 25 formed on side 24 of housing 20, an operator pulls side 24, along frame 120, away from side 26. Frame 120 is made long enough to enable an operator to fully separate side 24 from side 26, permitting full servicing of stones 40 and 70. Frames of prior art mills are not long enough and require the stones to be lifted from the frame. Because dressing the stones requires them to be placed together and rotated several times, this simple change in frame length greatly reduces the exertion in dressing the stones. In addition, strips of polyurethane 128 are positioned between side 24 and frame 120, allowing an operator to separate sides 24 and 26 without excessive exertion. When dressing is completed, side 24 is pushed toward side 26 until side 24 is flush with flange 37 of side 26.

Figure 6:
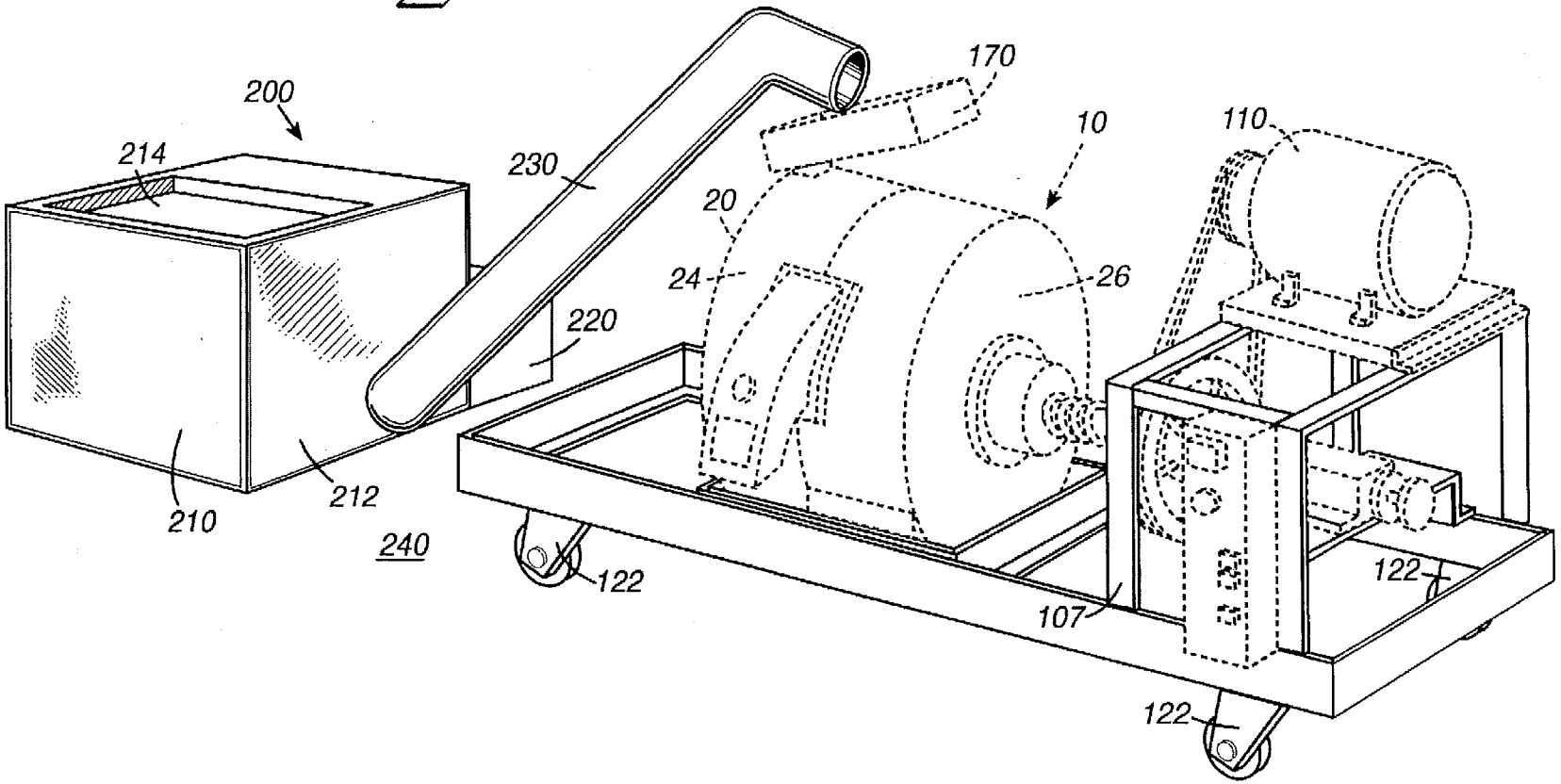
FIG. 6 is a perspective view of a grain feeder connected to a grain mill to according to an alternative preferred embodiment of the present invention.

Turning now to FIG. 6, there is illustrated a mill 10 with a grain feeder 200 according to an alternative preferred embodiment of the present invention. Grain feeder 200 contains a grain storage bin 210 and a motor 220 which drives a feed auger 230 attached to side 212 of bin 210. In operation, an operator places grain in an opening 214 of bin 210 and activates motor 220. Auger 230 will then forward grain to pan 170, at which time the milling of the grain will proceed in accordance with the procedure discussed above. Bin 210 is preferably placed upon ground 240, thereby permitting an operator to place grain in opening 214 without undue exertion.

It will be apparent to those skilled in the art that many modifications and substitutions can be made to the preferred embodiment just described without departing from the spirit and scope of the invention as defined in the appended claims.

What is claimed is:

1. A mill for milling grain, said mill comprising:

a frame;

a housing mounted to said frame and having a first side, a second side, a top, an interior, an inlet positioned in said top, and an exit spout;

a hopper connected to said inlet;

a first grinding stone in said interior of said housing;

a second grinding stone in said interior of said housing, said second grinding stone spaced apart from said first grinding stone by a distance;

means for feeding grain between said first and second grinding stones;

a shaft having a first end and a second end, said shaft extending through said interior of said housing, said second stone being attached to said shaft so that said second stone rotates when said shaft rotates;

means for rotating said shaft;

a first series of self-aligning beatings journaled to said first end of said shaft, said first set of self-aligning beatings extending from said first side of said housing;

a second series of self-aligning beatings journaled to said shaft, said second set of self-aligning bearings extending from said second side of said housing; and means for fixing said distance between said first and said second stones.

2. The mill as recited in claim 1, wherein said housing is formed to dissipate heat.

3. The mill as recited in claim 1, wherein said housing is made of stainless steel.

4. The mill as recited in claim 1, wherein said rotating means includes a motor that draws an electrical current when rotating said shaft, and wherein said mill further comprises means for monitoring said current.

5. The mill as recited in claim 1, further comprising means for monitoring the temperature in said interior of said housing.

6. The mill as recited in claim 1, further comprising a door formed in said exit spout.

7. The mill as recited in claim 1, wherein said mill further comprises means for magnetically removing metal particles from said grain.

8. A mill for milling grain, said mill comprising:

a frame;

a housing mounted to said frame and having a first side, a second side, a top, an interior, an inlet positioned in said top, and an exit spout;

a first grinding stone in said interior of said housing;

a second grinding stone in said interior of said housing, said second grinding stone spaced apart from said first grinding stone by a distance;

means for feeding grain between said first and second grinding stones;

a shaft having a first end and a second end, said shaft extending through said interior of said housing, said second stone being attached to said shaft so that said second stone rotates when said shaft rotates;

means for rotating said shaft;

a first series of self-aligning bearings journaled to said first end of said shaft, said first set of self-aligning bearings extending from said first side of said housing;

a second series of self-aligning bearings journaled to said shaft, said second set of self-aligning bearings extending from said second side of said housing;

means for sensing temperature in said interior of said housing; and means for fixing said distance between said first and said second stones.

9. The mill as recited in claim 8, wherein said housing is formed to dissipate heat.

10. The mill as recited in claim 8, wherein said housing is made of stainless steel.

11. The mill as recited in claim 8, wherein said rotating means includes an electric motor, said motor drawing an electric current when said motor rotates said shaft, and wherein said mill further comprises means for monitoring said electrical current.

12. The mill as recited in claim 8, further comprising a door formed in said exit spout.

13. The mill as recited in claim 8, wherein said mill includes means for magnetically removing metal particles from said grain.

14. A mill for milling grain, said mill comprising:

a frame;

a housing mounted to said frame and having a first side, a second side, a top, an interior, an inlet positioned in said top, and an exit spout, said housing formed to dissipate heat;

a first grinding stone in said interior of said housing;

a second grinding stone in said interior of said housing, said second grinding stone spaced apart from said first grinding stone;

means for feeding grain between said first and second grinding stones;

a shaft having a first end and a second end, said shaft extending through said interior of said housing, said second stone being attached to said shaft so that said second stone rotates when said shaft rotates;

means for rotating said shaft;

bearing means carried by said housing and engaging said shaft;

means for sensing temperature in said interior of said housing; and means for fixing the relative position of said first and said second grinding stones.

15. The mill as recited in claim 14, wherein said housing is made of stainless steel.

16. The mill as recited in claim 14, wherein said rotating means is an electric motor, and wherein said mill further comprises means for monitoring said current drawn by said motor.

* * * * *

US005673862B1

(12) REEXAMINATION CERTIFICATE (4481st)

United States Patent

Wingler

(10) Number: US 5,673,862 C1

(45) Certificate Issued: Nov. 6, 2001

(54) GRAIN MILL

(75) Inventor: Edward C. Wingler, Scottsville, NC (US)

(73) Assignee: New River Mills, L.L.C., Columbia, SC (US)

Reexamination Request:
No. 90/005,642, Feb. 22, 2000

Reexamination Certificate for:

| | |
|---|---|
| Patent No.: | **5,673,862** |
| Issued: | **Oct. 7, 1997** |
| Appl. No.: | **08/629,981** |
| Filed: | **Apr. 9, 1996** |

(51) Int. Cl.[7] ..... B02C 7/14

(52) U.S. Cl. ..... 241/81; 241/259.1

(58) Field of Search ..... 241/81, 259.1, 241/261.2, 261.3

(56) References Cited

U.S. PATENT DOCUMENTS

| | | | | |
|---|---|---|---|---|
| 512,846 | | 1/1894 | Straub . | |
| 1,046,019 | | 12/1912 | Reynolds . | |
| 1,251,299 | | 12/1917 | Sockwell . | |
| 3,617,006 | | 11/1971 | Jones . | |
| 3,761,027 | | 9/1973 | Mendoza . | |
| 4,023,739 | * | 5/1977 | Lampe et al. | 241/296 |
| 4,039,153 | | 8/1977 | Hoffman . | |
| 4,074,869 | | 2/1978 | Johnson . | |
| 4,339,083 | | 7/1982 | Linzberger et al. . | |
| 4,449,670 | | 5/1984 | Tloczynski et al. . | |
| 4,896,836 | | 1/1990 | Mitchell . | |

OTHER PUBLICATIONS

Practical Milling, Professor B.W. Dedrick, First Edition, National Miller, Chicago, Illinois, 1924, Chapters III, X, XI and XIII.

Operating Instructions and Parts List Applying to Stone Burr Grist Mills Serial No. 30,000 and Up, Meadows Mill Company, Inc., North Wilkesboro, North Carolina, Jan. 1, 1950.

Meadows Master Meal Mills for the Large Commercial Miller, Meadows Mill Company, Inc., North Wilkesboro, North Carolina, 1940.

Operating Instructions and Parts List for Meadows Gold Medal Stone Burr Mills, Meadows Mill Company, Inc., North Wilkesboro, North Carolina, 1944.

The Versatile Millstone Workhouse of Many Industries, Jon A., Sass, Society for the Preservation of Old Mills, Knoxville, Tennesee, 1884.

CRC Handbook of Chemistry and Physics, David R. Lide, Ph.D., 80$^{th}$ Edition, CRC Press, Boca Raton, 1999.

Instructions for Setting Up and Operating the Meadows White Flint Granite Grist Mills Pamphlet, International Harvester Company, Chicago, Illinois, 1923.

Safety Adjustments, Reverse Lock Lever for The New Williams Mill, 1924.

Williams' Mill Pay, 1918.

Directions for Setting Up, Operating, and List of Repair Parts Applying to Dixie King Burr Mills, D.T. Bohon Co., Harrodsburg, Kentucky, 1920.

Dealer Net Prices on Repair Parts, Aug. 1, 1918.

* cited by examiner

*Primary Examiner*—Mark Rosenbaum

(57) ABSTRACT

A grain mill is disclosed comprising a heat-dissipating, stainless steel housing that holds a pair of grinding stones, one of which rotates with a shaft turned by an electric motor. The shaft is journaled on self-aligning bearings. The bearings and the housing cooperate to keep heat buildup from the grinding operation low so as not to damage the grain, even at higher grinding speed. As an additional check on mill temperature, a thermometer is included to provide temperature information, and an ammeter is connected to the electrical motor to provide information about the electrical current being drawn when the motor rotates the shaft as an indication of the stress on the shaft. A small door near the exit spout permits a check of the uniformity and size of the ground product. Finally, magnets on the hopper attract metal particles and hold them so that they do not enter the space between the grind stones, where they could damage the stones and become part of the product. Accordingly, the present mill is capable of higher productivity and a higher quality product. Numerous other improvements in the present mill make it easier to operate and more durable.

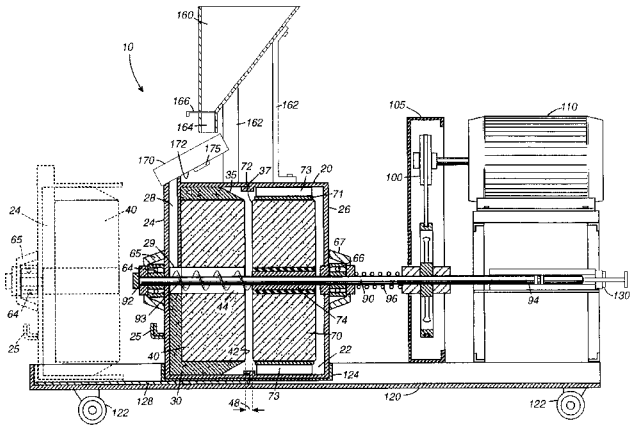

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–16 are cancelled.

New claims 17–28 are added and determined to be patentable.

*17. A mill for milling grain, said mill comprising:*

*a frame;*

*a housing mounted to said frame and having a first side, a second side, a top, an interior, an inlet positioned in said top, and an exit spout having a door formed therein, said housing made of stainless steel;*

*a first grinding stone in said interior of said housing;*

*a second grinding stone in said interior of said housing, said second grinding stone spaced apart from said first grinding stone;*

*means coating said frame to enable said stones to be slid apart easily, said frame dimensioned to permit said stones to be slid apart completely for dressing while remaining on said frame;*

*means for feeding grain between said first and second grinding stones;*

*means for magnetically removing metal particles from said grain;*

*a shaft having a first end and a second end, said shaft extending through said interior of said housing, said second stone being attached to said shaft so that said second stone rotates when said shaft rotates;*

*motor for rotating said shaft;*

*self-aligning bearing means carried by said housing and engaging said shaft;*

*means for sensing temperature in said interior of said housing;*

*means for fixing the relative position of said first and said second grinding stones; and*

*means for monitoring current drawn by said motor.*

*18. The grain mill of claim 17, wherein said coating means is selected from the group consisiting of polyethylene and tetrafluorohydrocarbon.*

*19. The grain mill of claim 17, wherein said stanless steel housing has a thickness of approximately one-quarter inch.*

*20. The grain mill of claim 17, wherein said self aligning bearing means is adapted to accommodate deviations in said shaft of up to 30 degrees.*

*21. The grain mill of claim 17, wherein said fixing means includes an adjustment screw having at least 24 threads per inch for fine adjustment of said relative position of said first and said second grinding stones.*

*22. The grain mill of claim 17, wherein said sensing means is a thermometer located on said housing at said exit spout.*

*23. A mill for milling grain, said mill comprising:*

*a frame;*

*a housing mounted to said frame and having a first side, a second side, a top, an interior, an inlet positioned in said top, and an exit spout, said housing made of stainless steel;*

*a first grinding stone in said interior of said housing;*

*a second grinding stone in said interior of said housing, said second grinding stone spaced apart from said grinding stone, said first and second grinding stones being made of granite;*

*means for feeding grain between said first and second grinding stones;*

*means for removing metal particles from said grain;*

*a shaft having a first end and a second end, said shaft extending through said interior of said housing, said second stone being attached to said shaft so that said second stone rotates when said shaft rotates;*

*motor for rotating said shaft;*

*self-aligning bearing means carried by said housing and engaging said shaft; and*

*means for fixing the relative position of said first and said second grinding stones,*

*wherein said frame is dimensioned to permit said stones to be slid apart completely for dressing while remaining on said frame.*

*24. The mill as recited in claim 23, wherein said removing means is a magnet carried by said housing.*

*25. The mill as recited in claim 23, further comprising an ammeter in electrical connection with said motor.*

*26. The mill as recited in claim 23, further comprising a thermometer carried by said housing.*

*27. The mill as recited in claim 23, wherein said self aligning bearing means is adapted to accommodate deviations in said shaft of up to 30 degrees.*

*28. The mill as recited in claim 23, wherein said frame is coated with a material selected from the group consisting of polyethylene and tetrafluorohydrocarbon.*

* * * * *